US005460774A

United States Patent [19]

Bachelet

[11] Patent Number: 5,460,774

[45] Date of Patent: Oct. 24, 1995

[54] METHOD OF MANUFACTURING AXISYMMETRIC COMPONENTS MADE OF A COMPOSITE MATERIAL HAVING A METALLIC MATRIX

[75] Inventor: Eric Bachelet, Paris, France

[73] Assignee: Societe Nationale D'Etude Et De Construction De Moteurs D'Aviation "SNECMA", Paris, France

[21] Appl. No.: 356,127

[22] Filed: Dec. 15, 1994

[30] Foreign Application Priority Data

Dec. 15, 1993 [FR] France ..... 93 15052

[51] Int. Cl.[6] ..... B22F 7/04

[52] U.S. Cl. ..... 419/5; 419/4; 419/10; 419/14; 419/49; 428/545; 428/615

[58] Field of Search ..... 419/4, 5, 10, 14, 419/49; 428/545, 615

[56] References Cited

U.S. PATENT DOCUMENTS

H1,261 12/1993 Gibson et al. ..... 156/169

3,915,776 10/1975 Kaempen ..... 156/161

4,867,644 9/1989 Wright et al. ..... 416/230

4,876,050 10/1989 Horton ..... 264/102

*Primary Examiner*—Peter A. Nelson

*Assistant Examiner*—Scott T. Bluni

*Attorney, Agent, or Firm*—Oblon, Spivak, McClelland, Maier & Neustadt

[57] ABSTRACT

A method of manufacturing an axisymmetric component made of a composite material having a metallic matrix is described in which at least one ceramic fiber and at least one wire of the metal which is to constitute the matrix are wound simultaneously side by side to form a number of layers on a suitably shaped mandrel and in such a manner as to ensure absence of contact between the fiber turns of each individual layer and between the fiber turns of adjacent layers, and the formed layers are subsequently subjected to hot isostatic compaction. The ceramic fiber may be of the silicon carbide type and the metal wire forming the matrix may be of titanium or titanium-alloy.

6 Claims, 1 Drawing Sheet

METHOD OF MANUFACTURING AXISYMMETRIC COMPONENTS MADE OF A COMPOSITE MATERIAL HAVING A METALLIC MATRIX

BACKGROUND OF THE INVENTION

1. Field of the Invention

The invention relates to a method of manufacturing axisymmetric components made of a composite material having a metallic matrix.

It is known that, in the future, metallic matrix composite materials will be used in the aeronautical industry and in the construction of aircraft engines, such materials having the advantage of being mechanically very strong and very heat resistant as well as having a lower mass than conventional metallic materials.

Such composite materials may, for example, consist of a metal matrix of the titanium or titanium-alloy type and of reinforcement fibers of the ceramic type, for example of silicon carbide, SiC.

2. Summary of the Prior Art

The techniques currently employed for producing large sized axisymmetric components made of a composite material comprising a titanium or titanium-alloy matrix reinforced with silicon carbide fibers are described in French patent 2,289,425 in the name of the present Applicant company and in French patent 2,366,904 in the name of Armines.

A first technique consists of winding the fiber which is to form the reinforcement on a mandrel so as to form a layer on said mandrel, carrying out a plasma deposition of the material which is to form the matrix on said fiber layer, and then repeating these winding and plasma deposition steps as many times as required before finally carrying out hot compaction of the structure obtained.

This technique has the drawback of not permitting an equally spaced arrangement of the fibers in the material as a result of the need to carry out, for each fiber layer, two inclined plasma depositions in order to fill up the spaces between the turns of the wound fiber with matrix metal, and a third plasma deposition in the direction radial to the mandrel so as to cover the fiber with matrix metal for the subsequent winding of the next fiber layer.

A second known technique consists of alternately winding a fiber reinforcing layer and applying a foil of matrix metal on the wound fiber layer. The drawbacks of this technique are the risk of making folds in the foil, the risk of not covering the fibers uniformly, and the difficulty of producing satisfactory successive stacks. As a result, the structure of the final material after hot compaction is liable to include local stress concentrations deleterious to the correct behavior of the material in the harsh environments for which it is intended.

In addition, French patent 2,640,195 to Rolls Royce discloses a process for producing wound composite structures, in which ceramic fibers and titanium wires are used. The titanium wires are twisted around the ceramic fibers, and the structures obtained are then wound around each other in the manner of a multistrand rope. The resulting structure is then wound inside a preform before being infiltrated by a metal whose melting point is lower than that of titanium, and subsequently hot formed.

SUMMARY OF THE INVENTION

It is an object of the present invention to provide a novel method of producing axisymmetric components made of a metallic matrix composite which does not suffer from the drawbacks mentioned hereinabove, and which enables final components to be obtained having a homogeneous structure without local stress concentrations and avoiding reactive diffusion within the material.

A further object is to provide such a method which is simpler and more economical than the existing methods.

Accordingly, the invention provides a method of manufacturing an axisymmetric component made of a composite material having a metallic matrix, comprising the steps of:

providing a mandrel of an appropriate shape;

providing at least one ceramic reinforcement fiber and at least one wire of the metal which is to constitute said matrix;

simultaneously winding said at least one ceramic reinforcement fiber and said at least one metal wire side by side on said mandrel to form at least one layer such that there is no contact between any of the turns of said ceramic reinforcement fiber in said at least one layer; and, subjecting said at least one layer on said mandrel to hot isostatic compaction.

Preferably, the reinforcement fibers and the metal wires have similar diameters so as to ensure contiguous winding between the turns as well as between adjacent layers, and the winding is carried out in such a manner that the reinforcement fibers are always separated from one another by at least one wire in each layer and from one layer to another.

The number of reinforcement fibers and metal wires to be simultaneously cowound depends on the desired volume distribution in the final material.

Preferably, the reinforcement fiber is a silicon carbide fiber and the metal wire is a titanium or titanium alloy wire.

Further preferred features of the invention will become apparent from the following description of the preferred embodiments, given by way of example, with reference to the appended drawings.

DESCRIPTION OF THE PREFERRED EMBODIMENTS

EMBODIMENT 1

Figure 1:
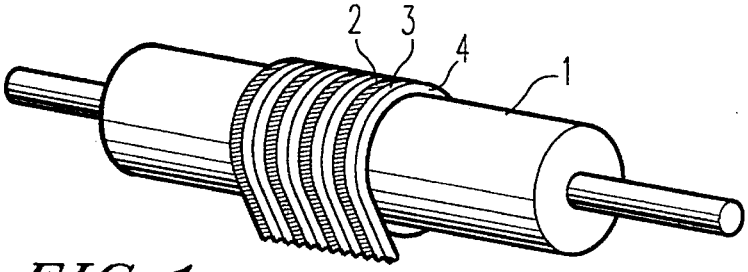
FIG. 1 depicts a mandrel about which a 3-filament winding is being carried out.
Figure 2:
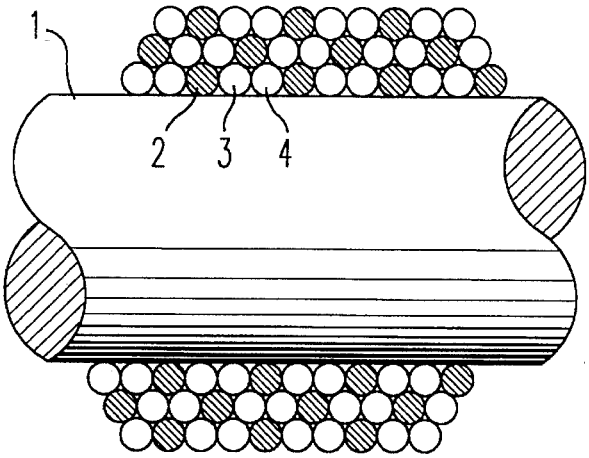
FIG. 2 depicts an axial section, to a larger scale, of the mandrel on which the 3-filament winding has been carried out.

This is an example of the method in accordance with the invention involving 3-filament winding, and is illustrated in FIGS. 1 and 2 of the appended drawings. The following manufacturing stages are involved.

a. One silicon carbide fiber 2 and two titanium wires 3 and 4, all of the same diameter, are simultaneously wound side by side on a mandrel 1 of suitable shape so as to form a first layer on the mandrel, the shape of the mandrel corresponding to the inner surface of the component to be produced.

b. The three filaments 2, 3 and 4 are continued to be wound in order to form a second layer on the first layer in which the filaments are offset by one diameter with respect to the corresponding filaments of the first layer, as is depicted in FIG. 2.

c. The three filaments 2, 3 and 4 continue to be wound to form further layers until the desired thickness on the mandrel is obtained, each layer always being offset by one filament diameter with respect to the preceding layer.

d. The structure is then sealed and densified by hot isostatic compaction.

The component thus obtained has a volume distribution of approximately 33.3% fibers and 66.7% metallic matrix.

EMBODIMENT 2

Figure 3:
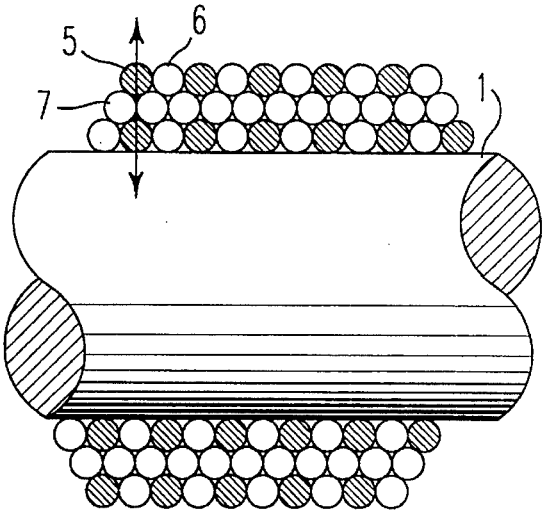
FIG. 3 depicts an axial section of the mandrel in an embodiment in which a 2-filament winding has been carried out; and, FIG. 4 depicts a view similar to FIG. 3 but in which a variant form of the 2-filament winding has been carried out.

This example of the method in accordance with the invention is illustrated by FIG. 3 of the appended drawings and involves 2-filament winding as follows.

a. One silicon carbide fiber 5 and one titanium wire 6, both of the same diameter, are simultaneously wound side by side on a mandrel 1 of suitable shape so as to form a first layer on the mandrel.

b. A second layer is then formed on the first layer by the simultaneous winding of two titanium wires 7 side by side.

c. A third layer is formed on the second layer in the same way as the first layer is formed, and so that the fibers 5 of the third layer are aligned radially with the fibers 5 of the first layer.

d. The previous two steps b and c are repeated alternately until the desired thickness is obtained.

e. The structure is sealed and densified by hot isostatic compaction. The component thus obtained possesses a volume distribution of 25% fibers and 75% metallic matrix.

EMBODIMENT 3

Figure 4:
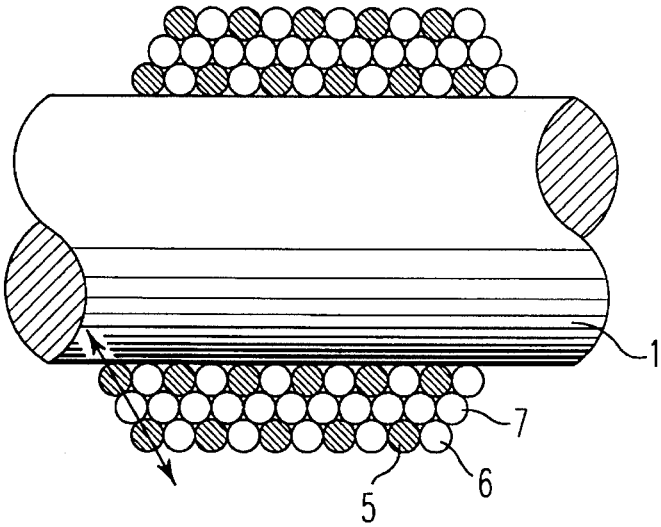

This example of the method in accordance with the invention is illustrated in FIG. 4 of the appended drawings, and is a variant of the previous embodiment as follows.

a. First and second layers are formed on a mandrel in a manner identical to steps a and b of Embodiment 2.

b. A third layer is then formed on the second layer by the simultaneous winding side by side of the silicon carbide fiber 5 and the titanium wire 6 so that they are offset by one diameter with respect to the corresponding fibers and wires of the first layer, as is depicted in FIG. 4.

c. Further layers are formed until the desired thickness is obtained, by winding two titanium wires in a manner similar to step b of Embodiment 2 alternately with winding a titanium wire and an SiC fiber side by side such that they are offset by one diameter with respect to the fibers and wires of the previous corresponding layer.

d. The structure is sealed and densified by hot isostatic compaction.

As in Embodiment 2, the component obtained possesses a volume distribution of 25% fibers and 75% matrix.

Of course, the method in accordance with the invention is not limited to the embodiments as described, which are given by way of illustration. It will be possible, for example, to apply the method using materials other than silicon carbide and titanium.

The number of fibers and metal wires simultaneously wound side by side may be greater than those given in the embodiments. It will also be possible to insert layers of other materials, the principle remaining that the ceramic fibers do not touch each other, either during winding or during hot isostatic compaction.

The method in accordance with the invention is particularly applicable to the production of turbomachine components, for example compressor spools.

I claim:

1. A method of manufacturing an axisymmetric component made of a composite material having a metallic matrix, comprising the steps of:

providing a mandrel of an appropriate shape;

providing at least one ceramic reinforcement fiber and at least one wire of the metal which is to constitute said matrix;

simultaneously winding said at least one ceramic reinforcement fiber and said at least one metal wire side by side on said mandrel to form at least one layer such that there is no contact between any of the turns of said ceramic reinforcement fiber in said at least one layer; and, subjecting said at least one layer on said mandrel to hot isostatic compaction.

2. A method according to claim 1, wherein said ceramic reinforcement fiber and said metal wire have similar diameters.

3. A method according to claim 1, wherein said ceramic reinforcement fiber is a silicon carbide fiber.

4. A method according to claim 1, wherein said metal wire is made of a metal selected from the group consisting of titanium and titanium-alloys.

5. A method according to claim 1, wherein said winding step comprises simultaneouly winding one ceramic reinforcement fiber and two metal wires side by side to from a plurality of layers on said mandrel such that each successive layer is offset relative to the immediately preceding layer by the diameter of said fiber.

6. A method according to claim 1, wherein said winding step comprises simultaneously winding one ceramic reinforcement fiber and one metal wire side by side to form a first layer, and said method includes, further winding step of simultaneously winding two metal wires side by side after said winding step to form a second layer on said first layer, and repeating said winding step and said further winding step alternately until the desired number of layers has been formed.

* * * * *

UNITED STATES PATENT AND TRADEMARK OFFICE

CERTIFICATE OF CORRECTION

PATENT NO. : 5,460,774

DATED : OCTOBER 24, 1995

INVENTOR(S) : ERIC BACHELET

It is certified that error appears in the above-indentified patent and that said Letters Patent is hereby corrected as shown below:

Column 4, line 45, delete "from" and insert --form--.

Signed and Sealed this

Eleventh Day of June, 1996

*Attest:*

*Attesting Officer*

Bruce Lehman

BRUCE LEHMAN

*Commissioner of Patents and Trademarks*